US007136598B2

(12) United States Patent
Suzuki

(10) Patent No.: US 7,136,598 B2
(45) Date of Patent: Nov. 14, 2006

(54) IMAGE FORMING APPARATUS, UNIT OF IMAGE FORMING APPARATUS AND INFORMATION CONTROL METHOD OF IMAGE FORMING APPARATUS

(75) Inventor: Tomohisa Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 3 days.

(21) Appl. No.: 10/959,347

(22) Filed: Oct. 7, 2004

(65) Prior Publication Data

US 2005/0078971 A1 Apr. 14, 2005

(30) Foreign Application Priority Data

Oct. 9, 2003 (JP) ..... P.2003-351099

(51) Int. Cl.
*G03G 15/00* (2006.01)

(52) U.S. Cl. ..... 399/12; 399/25

(58) Field of Classification Search ..... 399/25, 399/12, 24, 27, 13
See application file for complete search history.

(56) References Cited

U.S. PATENT DOCUMENTS 6,408,141 B1 * 6/2002 Tahara ..... 399/12
6,560,414 B1 * 5/2003 Suda et al. ..... 399/12
6,658,219 B1 * 12/2003 Ito et al. ..... 399/27
6,704,521 B1 * 3/2004 Isobe et al. ..... 399/12
6,711,362 B1 * 3/2004 Asakura ..... 399/12
7,044,574 B1 * 5/2006 Croley et al. ..... 347/19
2002/0127020 A1 * 9/2002 Childers ..... 399/12
2003/0053809 A1 * 3/2003 Ogata et al. ..... 399/12

FOREIGN PATENT DOCUMENTS

JP A-2000-98826 4/2000
JP A-2002-169429 6/2002

* cited by examiner

*Primary Examiner*—Robert Beatty
(74) *Attorney, Agent, or Firm*—Morgan, Lewis & Bockius LLP

(57) ABSTRACT

An image forming apparatus includes a main body, a main body storing portion provided at the main body, a unit attachable to the main body, a unit storing portion provided at the unit, a reading section to read first information in the unit storing portion to the main body storing portion, an updating section to update second information in the main body storing portion, a writing section to write the second information to the unit storing portion, and a determining section to determine whether the second information can be written to the unit storing portion based on the first information and the second information before writing the second information to the unit storing portion.

24 Claims, 8 Drawing Sheets

IMAGE FORMING APPARATUS, UNIT OF IMAGE FORMING APPARATUS AND INFORMATION CONTROL METHOD OF IMAGE FORMING APPARATUS

BACKGROUND OF THE INVENTION

1. Field of the Invention

The present invention relates to an image forming apparatus, a unit of an image forming apparatus, and an information control method of an image forming apparatus.

2. Description of the Related Art

In a background art, there is present a constitution of an image forming apparatus including an image forming main body, and a unit attachable to the image forming main body (for example, process cartridge). Further, according to such an image forming apparatus, there are provided storing portions respectively to the unit and the image forming main body, at respective predetermined timings, 1. information is read from the unit to the image forming main body, 2. the information is updated in accordance with a history of using the unit, and 3. the updated information is written to the unit. For example, according to technologies disclosed in JP-A-2000-98826, JP-A-2002-169429, in the case in which a power source of the image forming apparatus is made ON, when a main body door for making access to the unit is closed, 1. the information is read from the unit to the image forming main body, at each time of forming an image, 2. the information is updated, and when one page of an image has been finished to form or one job has been finished, 3. the updated information is written to the unit.

SUMMARY OF THE INVENTION

However, in the case of the above-described background art, the following problem is posed.

First, when the unit A is mounted to the main body A and used to substantially expire unit life, thereafter, the unit A is interchanged temporarily by a new unit B, information of the unit B is written to the main body A, and the unit B is interchanged again by the unit A in a mode in which interchange of the unit is prevented from being recognized by the main body (for example, an opening and closing switch of a door is devised), the information of the unit B is written to the unit A. As a result, the unit A is used to exceed inherent life.

Second, when the unit A is mounted to the main body A and is used for a period of time, thereafter, the unit A is mounted to other main body B to use temporarily in the mode in which interchange of the unit is prevented from being recognized by the main body (for example, the opening and closing switch of the door is devised), and the unit A is mounted again to the main body A in the mode in which interchange of the unit is prevented from being recognized by the main body, an amount of being used at the main body B is not written to the information of the unit A. As a result, the unit A is used to exceed the inherent life.

Third, when the power source of the image forming apparatus is made ON, or when the main body door is closed for making access to the unit, 1. during a time period of reading the information from the unit to the image forming main body, an image cannot be formed to make a user at standby. Meanwhile, the unit is not necessarily interchanged when the power source of the image forming apparatus is made ON or the like.

The invention has been carried out in order to resolve such a technical problem and provides an image forming apparatus, a unit of an image forming apparatus, and an information control method of an image forming apparatus capable of preventing the unit from being used to exceed inherent life. Further, it provides an image forming apparatus, a unit of an image forming apparatus, and an information control method of an image forming apparatus capable of swiftly forming an image without reading unnecessary information.

According to an aspect of the present invention, an image forming apparatus includes a main body, a main body storing portion provided at the main body, a unit attachable to the main body, a unit storing portion provided at the unit, a reading section to read information in the unit storing portion to the main body storing portion, an updating section to update information in the main body storing portion, and a writing section to write the information in the main body storing portion to the unit storing portion, further includes a determining section to determine whether the information in the main body storing portion can be written to the unit storing portion based on the information in the main body storing portion and the information in the unit storing portion before writing the information in the main body storing portion to the unit storing portion.

According to another aspect of the present invention, a unit of an image forming apparatus has a unit storing portion to store information and attachable to an image forming main body, wherein information in the unit storing portion is read to the main body storing portion of the image forming main body, updated and written to the unit storing portion. Preferably, it is determined whether information in the main body storing portion can be written to the unit storing portion based on information in the main body storing portion and the information in the unit storing portion just before writing the information in the main body storing portion to the unit storing portion.

According to yet another aspect of the present invention, an information control method of an image forming apparatus includes a main body, a main body storing portion provided to the main body, a unit attachable to the main body, and a unit storing portion provided at the unit and including a reading step of reading information in the unit storing portion to the main body storing portion, an updating step of updating information in the main body storing portion, and a writing step of writing the information in the main body storing portion to the unit storing portion, further includes a determining step of determining whether the information in the unit storing portion can be written to the main body storing portion based on the information in the main body storing portion and the information in the unit storing portion before the writing step.

According to yet another aspect of the present invention, an image forming apparatus includes a main body, a main body storing portion provided at the main body, a unit attachable to the main body, a unit storing portion provided at the unit, a reading section to read information in the unit storing portion to the main body storing portion, an updating section to update information in the main body storing portion, a writing section to write the information in the main body storing portion to the unit storing portion, and a determining section to determine whether the information in the main body storing portion can be written to the unit storing portion based on the information in the main body storing portion and the information in the unit storing portion before writing the information in the main body storing portion to the unit storing portion. Preferably, the reading section reads only inherent information in the information in the unit storing portion after the information in the main body storing portion is updated, the determining section compares inherent information in the information in the main body storing portion and the inherent information in the information in the unit storing portion, when the inherent information in the information in the main body storing portion and the inherent information in the information in the unit storing portion coincide with each other compares history information stored in the main body storing portion and read history information, and when the history information stored in the main body storing portion is equal to or less than the read history information renders the writing section to write the updated information in the main body storing portion to the unit storing portion and permits to form an image.

BRIEF DESCRIPTION OF THE DRAWINGS

Preferred embodiments of the present invention will be described in detail based on the following figures, wherein.

DETAILED DESCRIPTION OF THE INVENTION

An embodiment of the invention will be explained in reference to the drawings as follows.

Figure 1:
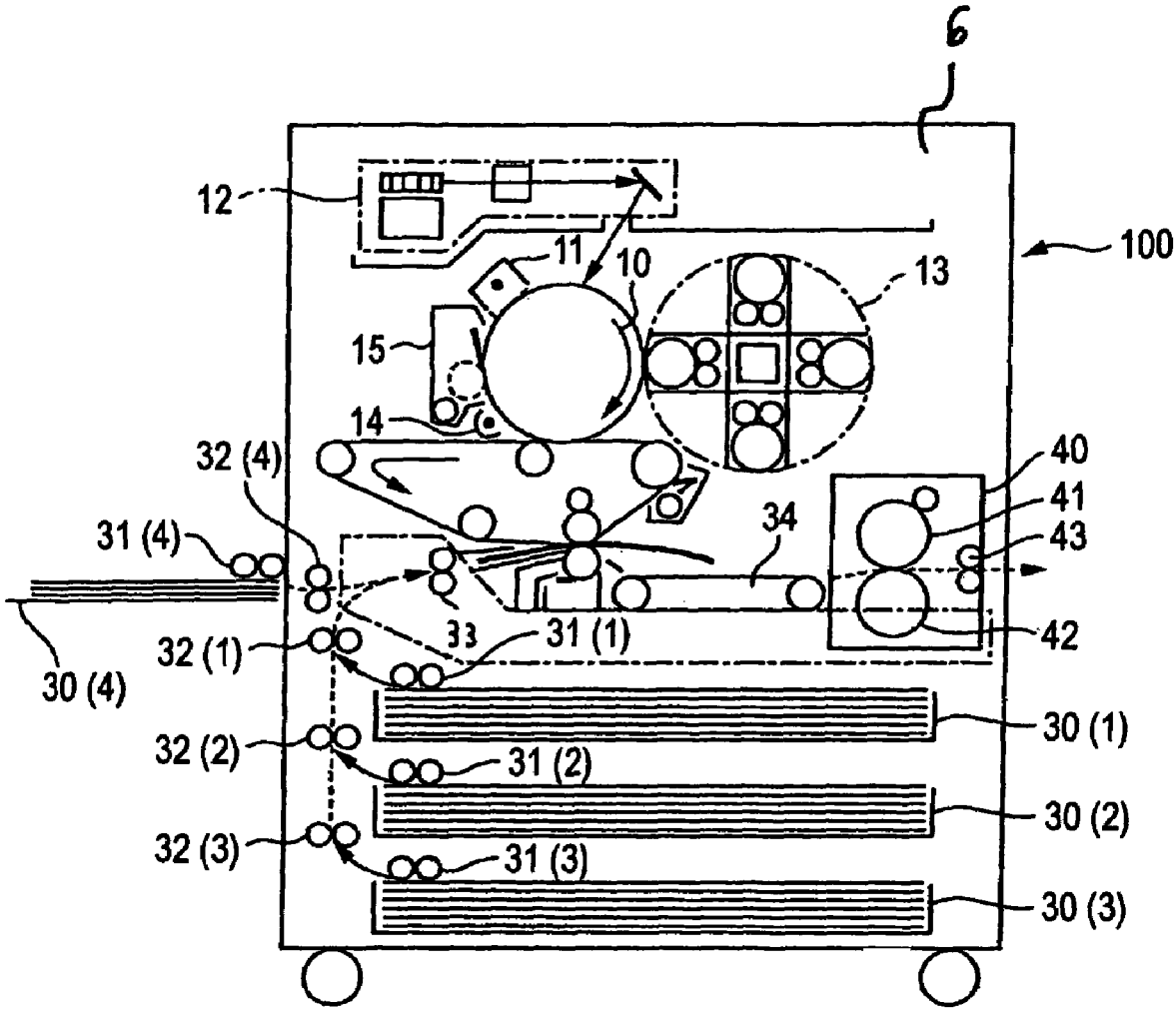
FIG. 1 is an outline sectional view of a full color printer according to an embodiment.
Figure 2:
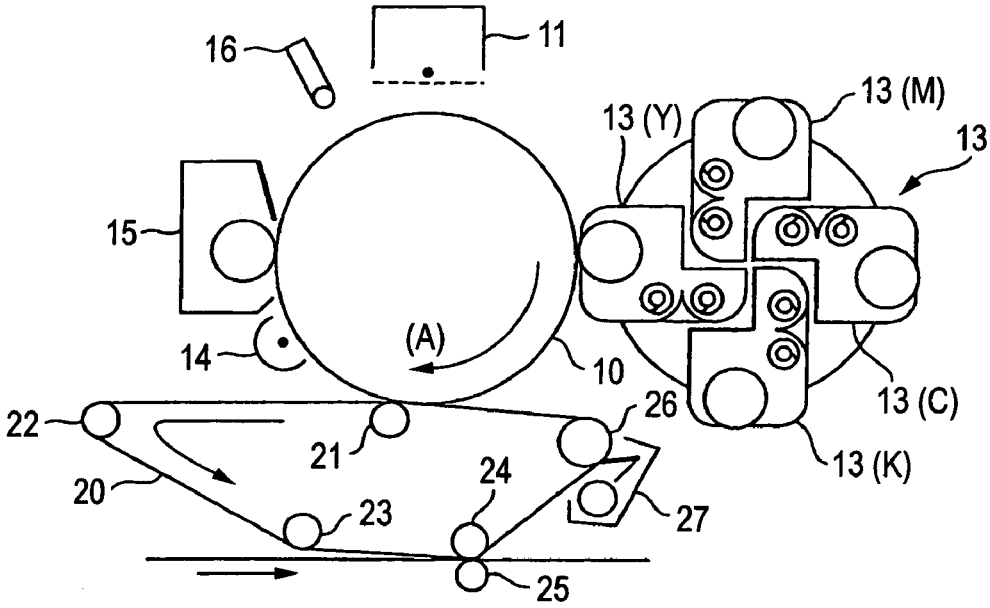
FIG. 2 is an outline sectional view of an image forming portion of the full color printer of FIG. 1.

FIG. 1 is an outline sectional view of a full color printer (image forming apparatus) 100 according to the embodiment. Further, FIG. 2 is an outline sectional view of a portion (image forming portion) of the full color printer 100.

First, a basic constitution of the full color printer 100 will be explained. The full color printer 100 is grossly constituted by an image forming portion, a transcribing portion, a feeding portion, and a fixing portion. The image forming apparatus includes a photosensitive drum 10 as an image carrier, a corotron 11 as a charging section, a laser exposing apparatus (ROS) 12 as an exposing section, a rotary processing apparatus 13 as a developing section, a precleaning corotron 14 as a cleaning assisting section, a drum cleaning apparatus 15, an electricity removing lamp 16 as an electricity removing section arranged at a surrounding of the photosensitive drum 10. The rotary processing apparatus 13 includes 4 colors of processing apparatus 13 (Y) (M) (C) (K) of yellow, magenta, cyan, black and is constituted to be able to oppose the respective processing apparatus 13 (Y) through 13 (K) to the photosensitive drum 10.

The transcribing portion includes a middle transcribing belt 20 in an endless shape as a middle transcriber, a primary transcribing roll 21, suspension rolls 22, 23, a backup roll 24, a drive roll 26, a secondary transcribing roll 25 opposed to the backup roll 24 by interposing the middle transcribing belt 20 hung around the middle transcribing belt 20, a belt cleaning apparatus 27 opposed to the drive roll 26 by interposing the middle transcribing belt 20 and the like.

The feeding portion includes three sheet trays 30 (1) through 30 (3) capable of containing a single kind or a plurality of kinds of record sheets, a hand charge tray 30 (4), pickup rolls 31 (1) through 31 (4), carry rolls 32 (1) through 32 (4), a resister roll 33, a belt sheet carrying apparatus 34 and the like.

The fixing portion includes a fixing apparatus 40 as a fixing section and the fixing apparatus 40 includes a heating roll 41, a pressing roll 42 brought into press contact with the heating roll 41, a discharge roll 43 and the like. Further, halogen lamps as heaters are contained inside the heating roll 41 and inside the pressing roll 42.

Next, basic operation of the full color printer 100 will be explained. A surface of the photosensitive drum 10 is uniformly charged by applying charge voltage to the corotron 11. The surface of the uniformly charged photosensitive drum 10 is irradiated with a laser beam in correspondence with a first color (here, 'yellow') from the exposing apparatus 12 based on image forming instruction from a computer, not illustrated. Then, a potential difference is produced between a portion of the surface of the photosensitive drum 10 which is exposed to the laser and a portion thereof which is not exposed thereto, as a result, an electrostatic latent image by the potential difference is formed. First, a processing apparatus 13 (Y) of yellow of the rotary processing apparatus 13 is opposed to the electrostatic latent image, a yellow toner is selectively transcribed to the electrostatic latent image on the photosensitive drum 10, and a toner image T (Y) by the yellow toner is formed on the photosensitive drum 10. The toner image T (Y) is primarily transcribed electrostatically onto the middle transcribing belt 20 by the primary transcribing roll 21 applied with primary transcribing bias. Further, a remaining toner slightly remaining on the photosensitive drum 10 is removed from above the photosensitive drum 10 by the drum cleaning apparatus 15 after weakening an electrostatic adhering force thereof with the photosensitive drum 10 by the precleaning corotron 14. Thereafter, a history of the potential difference is erased from the surface of the photosensitive drum 10 by removing electricity thereof by the electricity removing lamp 16 to prepare for successive charging or the like.

By repeating such a process by 4 times, a full color toner image T (F) by 4 colors of yellow, cyan, magenta, black is laminatedly formed on the middle transcribing belt 20. Further, the secondary transcribing roll 25 is separated from the middle transcribing belt 20 until passing at least a third color (here, 'magenta'). Similarly, the belt cleaning apparatus 27 is separated from the middle transcribing belt 20 until passing at least the third color. Further, the secondary transcribing roll 25 and the belt cleaning apparatus 27 are brought into contact with the middle transcribing belt 20 until the full color toner image T (F) reaches a secondary transcribing position.

Meanwhile, in synchronism with a timing at which the full color toner image T (F) reaches the secondary transcribing position, a desired kind of record sheets are taken out by the pickup rolls 31 (1) through 31 (4) sheet by sheet from any of the trays 30 (1) through 30 (4), carried by the respective carry rolls 32 (1) through 32 (4) and carried to the secondary transcribing position by the resister roll 33. At the secondary transcribing position, the full color toner image T (F) on the middle transcribing belt 20 and the carried record sheet are laminated, and the toner image T (F) is secondarily transcribed electrostatically onto the record sheet by operation of the secondary transcribing bias applied to the backup roll 24.

Thereafter, the record sheet holding the full color toner image T (F) is carried to the fixing apparatus 40 by the belt sheet carrying apparatus 34. At the fixing apparatus 40, the record sheet is passed to a nip region of the heating roll 41 and the pressing roll 42. When the record sheet passes the nip region, by operation of heat and pressure applied from the two rolls 41, 42, the full color toner image T (F) is fixed onto the record sheet. Further, the fixed record sheet is discharged to outside of the full color printer 100 by the discharge roll 43 to finish image forming operation of one sheet.

Meanwhile, according to the full color printer 100, the photosensitive drum 10, the charge corotron 14, the drum cleaning apparatus 15 and the like are integrally constituted as a process cartridge (unit) 5. Further, the process cartridge 5 is made to be attachable to other portion (hereinafter, referred to as main body 6') of the full color printer 100.

Figure 3:
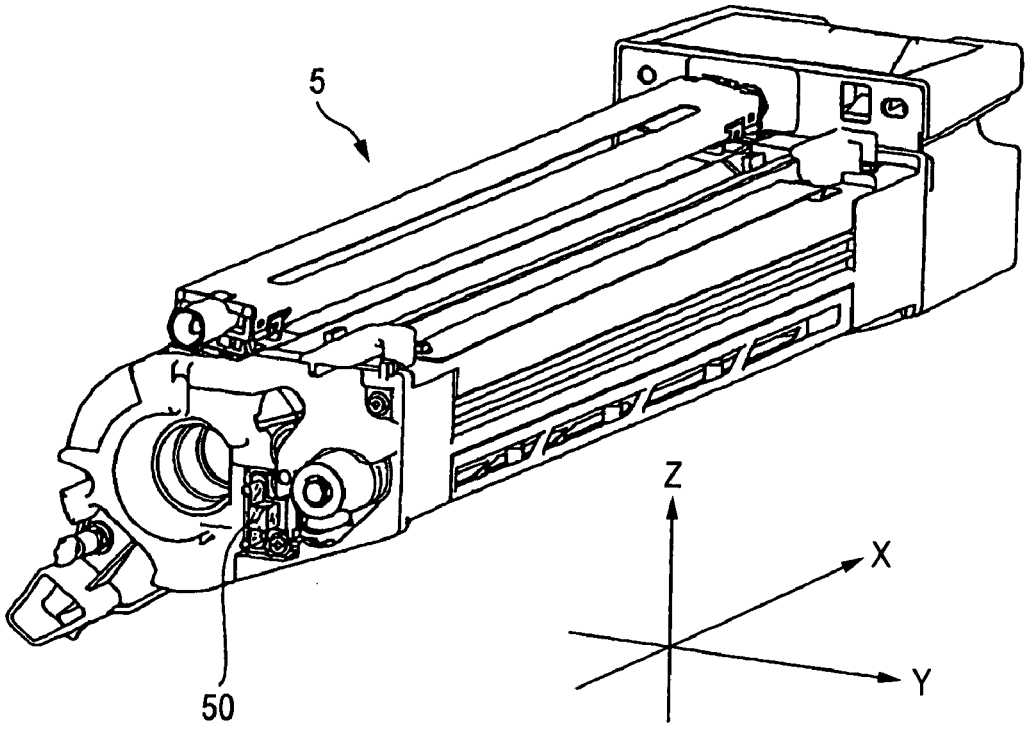
FIG. 3 is a perspective view of a process cartridge of the full color printer of FIG. 1.
Figure 4:
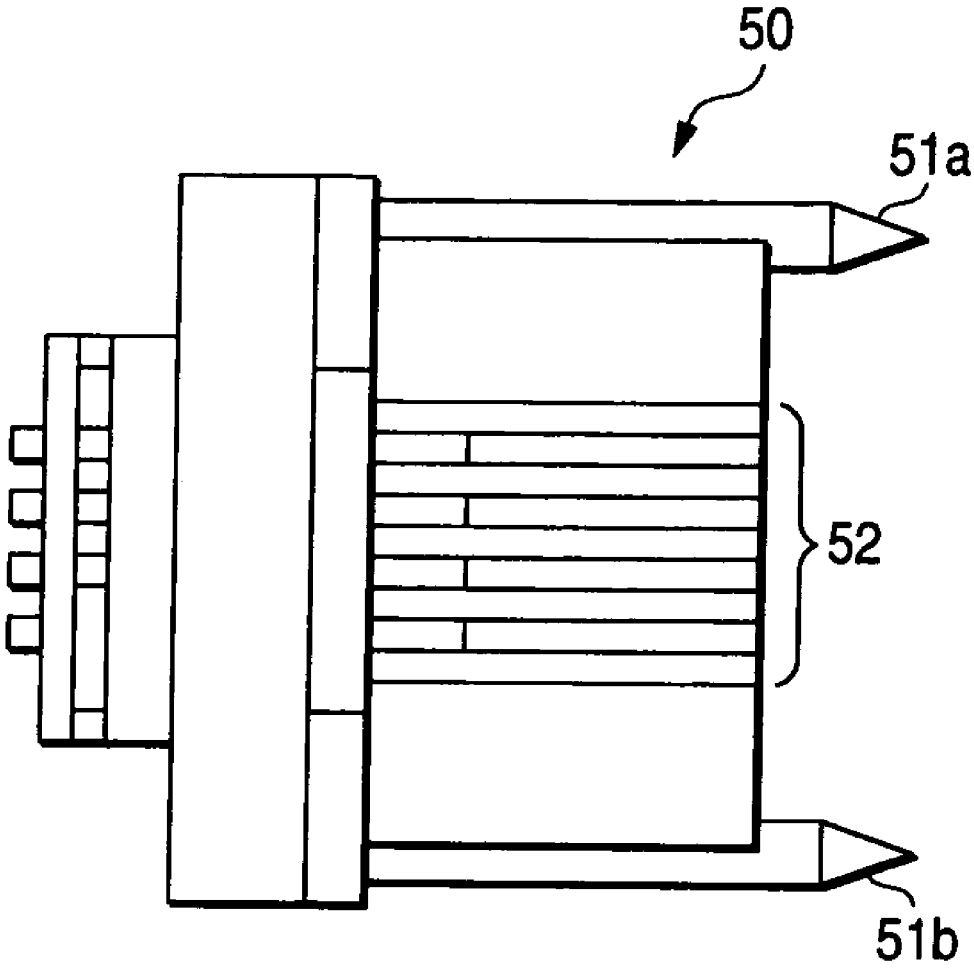
FIG. 4 is a front view of a storing portion of the process cartridge of FIG. 3.

FIG. 3 is a perspective view of the process cartridge 5. Respective arrow marks in the drawing respectively indicate a front and rear direction (X-(X) direction), a left and right direction (Y-(−Y) direction), and an up and down direction (Z-(−Z) direction). The process cartridge 5 can be removed from the main body 6 by opening a main body door (not illustrated) of the full color printer 100 and drawing the process cartridge 5 in a front direction, further, can be attached to the main body 6 by pushing the process cartridge 5 in a rear direction. FIG. 4 is a front view (X-Z plane) of FIG. 3) of a memory portion (unit storing portion) 50 of the process cartridge 5. The memory portion 50 includes positioning pins 51*a* and 51*b* for positioning when the process cartridge 5 is mounted to the main body 6, and a connecting terminal portion 52 for reading and writing information stored to the memory portion 50.

Figure 5:
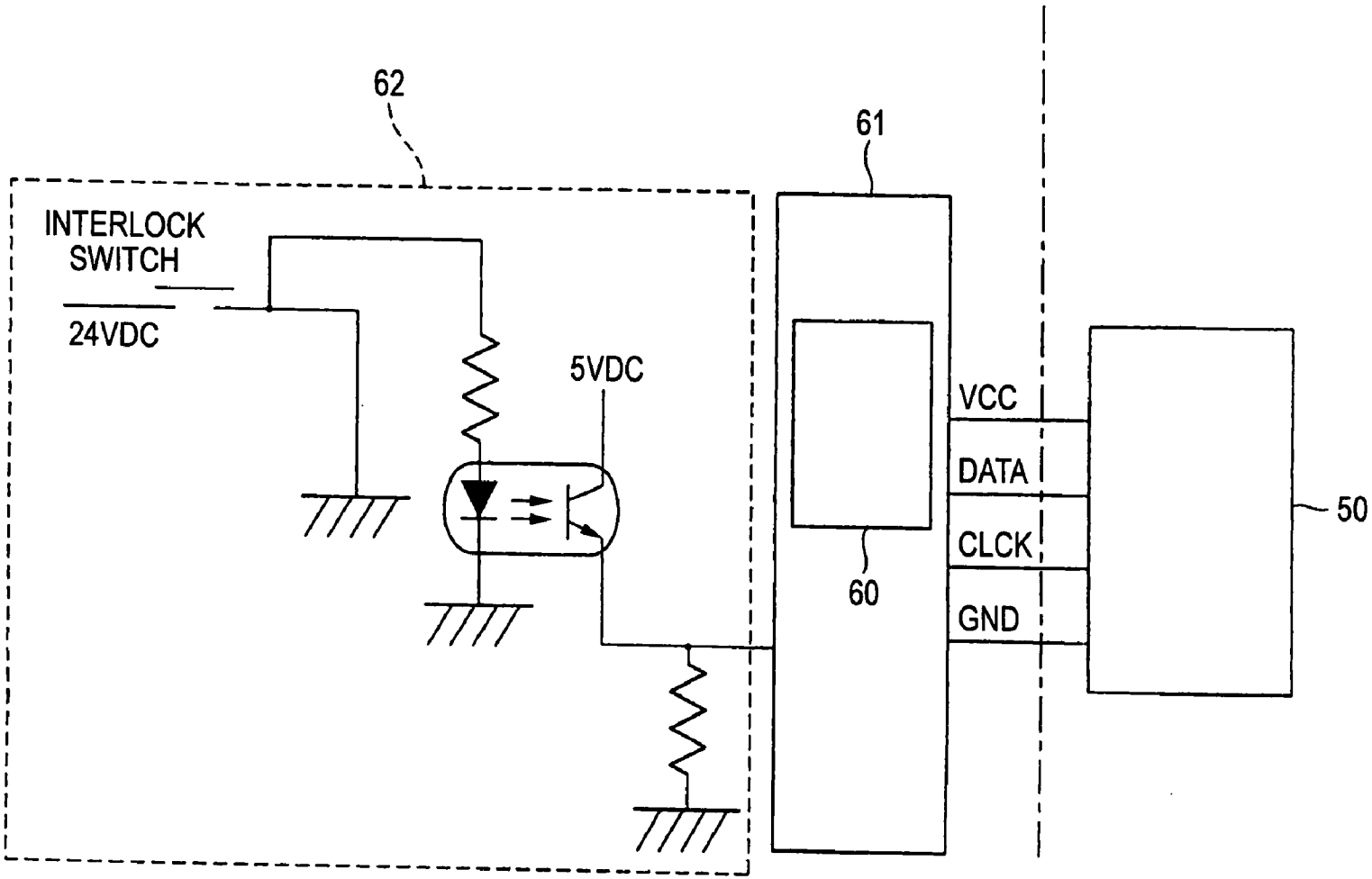
FIG. 5 is a control block diagram for explaining a control system of the full color printer of FIG. 1.

FIG. 5 is a block diagram for explaining a control system for controlling to update information in the two memory portions. As shown by the drawing, the control system is constituted centering on a controller (a reading section, an updating section, a writing section, a determining section) 61 and includes an opening/closing detecting portion 62 for inputting a signal to the controller 61, and the cartridge storing portion 50 for inputting and outputting a signal to and from the controller 61. Here, the controller 61 includes an operational control apparatus, a storing apparatus (including random access memory and read only memory), an input/output interface and the like which are connected to each other by information bus. A main body storing portion 60 constituted as an involatile memory is provided as a portion of the storing apparatus (random access memory). Further, a portion of the storing apparatus (read only memory) is stored with a control program (a reading section, an updating section, a writing section, a determining section) and by executing the control program by the operational control apparatus, the controller 61 can carry out various updating control operation. The cartridge storing portion 50 is constituted by EEPROM (electrically erasable programmable read only memory).

Further, when the process cartridge 5 is pertinently mounted to the main body 6, the controller 61 (main body storing portion 60) and the cartridge storing portion 50 are constituted to be physically connected by 4 pieces of metal wires (wires: a reading section, a writing section) and when the process cartridge 5 is detached from the main body 6, the controller 61 (main body storing portion 60) and the cartridge storing portion 50 are constituted to be released from being connected to each other. Further, although according to the embodiment, the controller 61 and the cartridge storing portion 50 read and write information via the wires, information can also be constituted to read and write via wireless. Further, although according to the embodiment, information is read and written by electric communication (by using pulse voltage or the like), information can be read and written also by optical communication.

Figure 6:
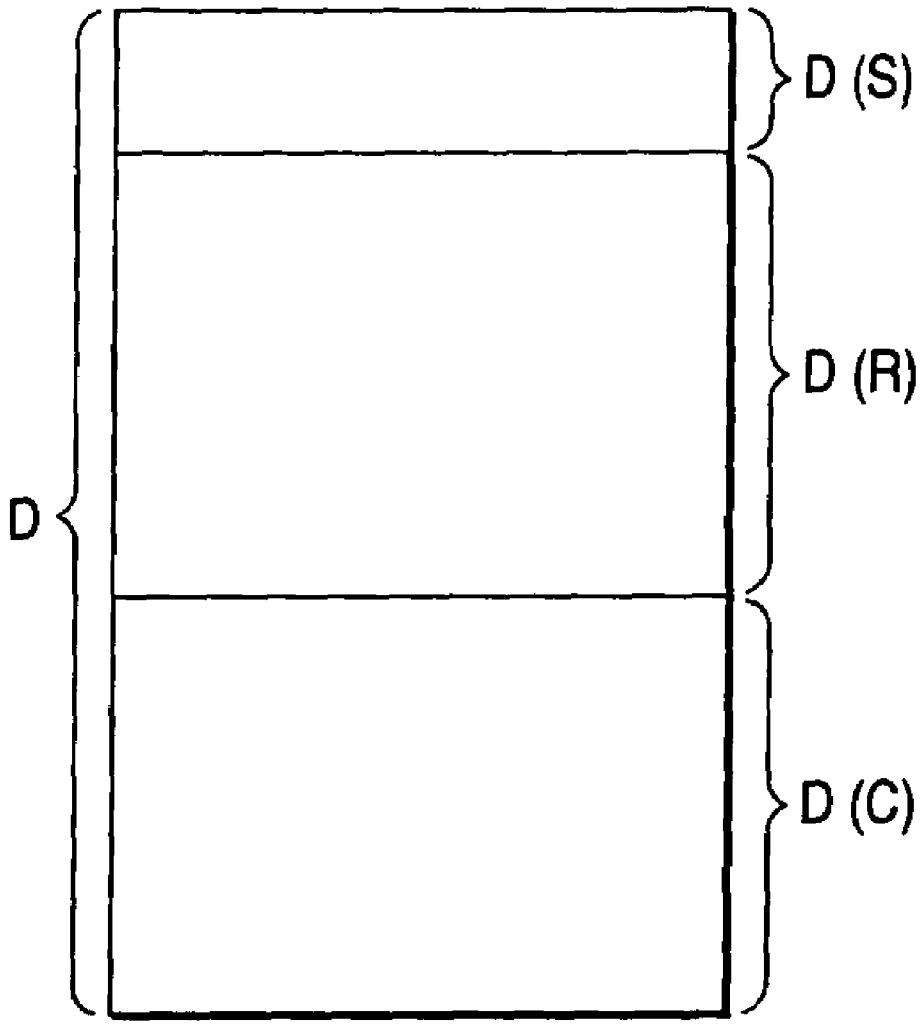
FIG. 6 is a view schematically showing information exchanged between the process cartridge and a main body.

FIG. 6 schematically explains information D stored to the cartridge storing portion 50 and the main body storing portion 60. The information D includes inherent information D (S), history information D (R) and control information D (C). Here, the inherent information D (S) is information inherent to the cartridge 5, and a capacity size thereof is smaller than those of the history information D (R) and the control information D (C). Further, the history information D (R) indicates a history of using the cartridge 5 and the main body 6, and is stored with, for example, an accumulated revolution number of the photosensitive drum 10, an accumulated number of operation (operation time period) of a developer carrying member inside the processing apparatus 13, an accumulated coverage rate of a toner portion in an image and the like and is stored with a situation of using the cartridge 5 (kind, size, frequency and the like of an output image), information of recycling the cartridge 5, location of fabrication, year, month, date of fabrication and the like. Further, the control information D (C) indicates image forming parameters, and is stored with, for example, a reference charge bias value, a reference developing value, a reference transcription bias value and the like.

Figure 7A:
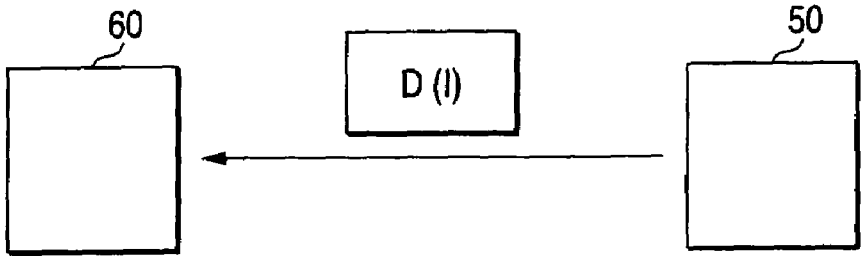
FIGS. 7A to 7C schematically show a behavior in which information is exchanged between the process cartridge and the main body.
Figure 7B:
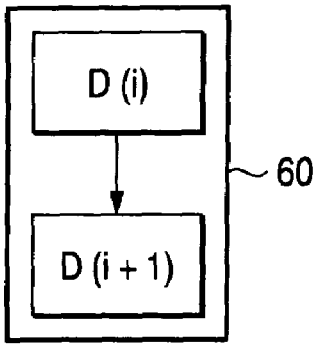
Figure 7C:
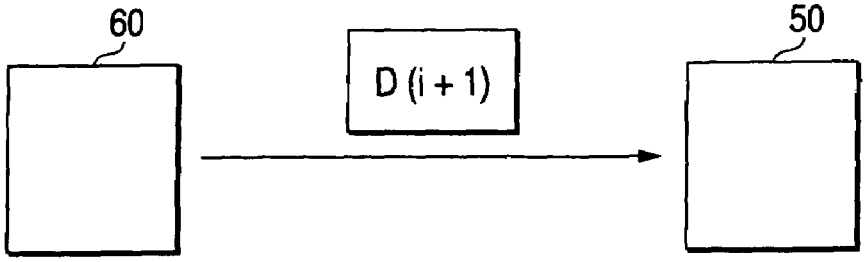

FIGS. 7A to 7C illustrate schematic views for explaining a basis of updating control operation of information stored to the two storing portions. As shown by the drawings, first, at a certain timing, information D (i) of the cartridge storing portion 50 is read by the main body storing portion 60 (refer to FIG. 7A). Next, at each time of forming an image by the full color printer 100, the information D is updated from information D (i) to information D (i+1)(refer to FIG. 7B). Further, at a certain timing, the updated information D (i+1) is written from the main body storing portion 60 to the cartridge storing portion 50 (refer to FIG. 7C).

Figure 8:
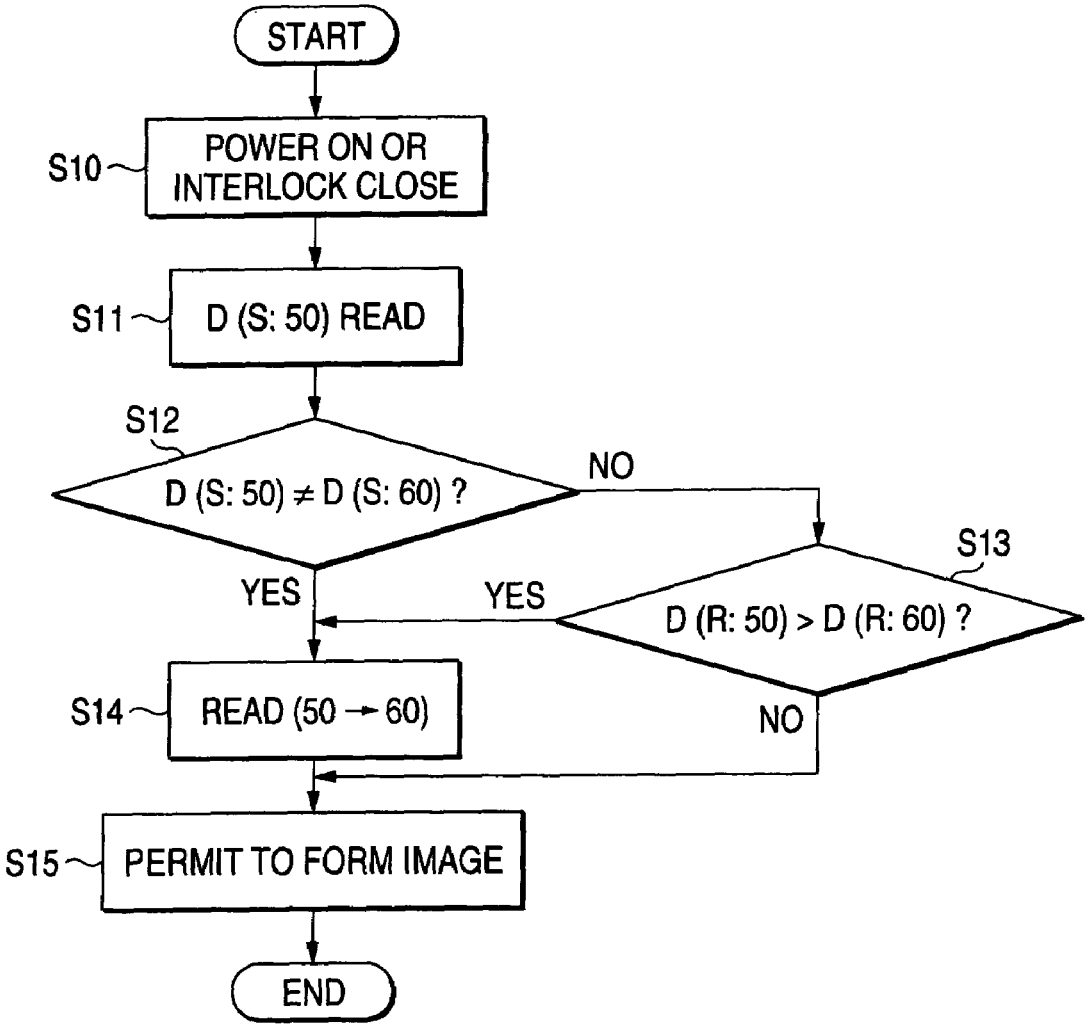
FIG. 8 is one flowchart for explaining exchange of information.
Figure 9:
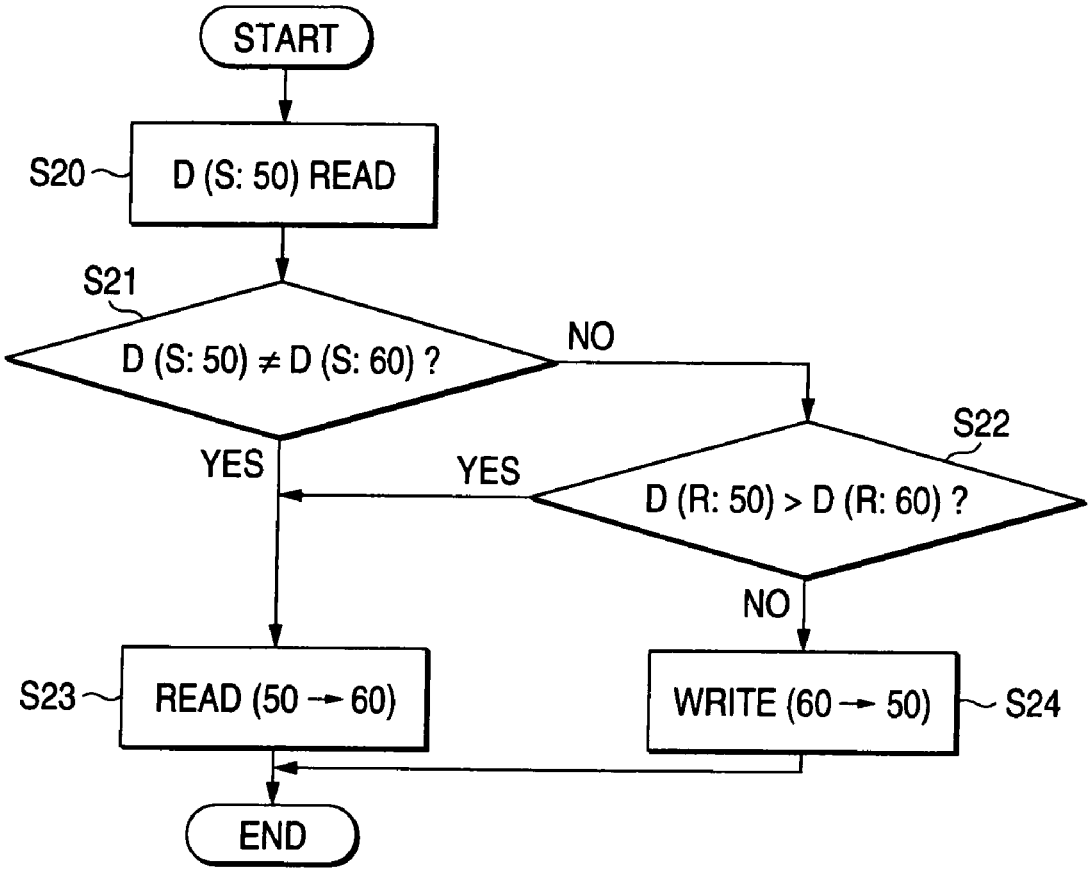
FIG. 9 is other flowchart for explaining exchange of information.

FIG. 8 and FIG. 9 are flowcharts for respectively explaining examples of updating control operation of information. An explanation will be given of updating control operation of information shown in the flowcharts as an embodiment as follows.

FIG. 8 is a flowchart when an image is formed after determining whether the process cartridge 5 has been interchanged. First, when the controller 61 detects that a power source of the full color printer 100 is made ON (S10), or when the controller 61 detects opening and closing a door of the full color printer 100 (door opened and closed when the process cartridge 5 is interchanged) based on a signal from the opening/closing detecting portion 62 (S10), the controller 61 reads only the inherent information D (S) in the information D stored to the cartridge storing portion 50 (S11). Further, inherent information D (S:60) stored to the main body storing portion 60 and read inherent information D (S:50) are compared (S12). Further, when the inherent information D (S:60) and the inherent information D (S:50) coincide with each other, the history information D (R:60) stored to the main body storing portion 60 and the read history information D (R:50) are compared. Further, when the history information D (R:60) and the history D (R:50) coincide with each other, the controller 61 permits to form an image as it is to thereby form the image (S15).

Meanwhile, when the inherent information D (S:60) and the inherent information D (S:50) differ from each other (S12), or in the case in which the history information D (R:50) is larger than the history information D (R:60)(even when the inherent information D (S:60) and the inherent information D (S:50) coincide with each other), the controller 61 reads the information D stored to the cartridge storing portion 50 to the main body storing portion 60 and thereafter permits to form an image to thereby form the image (S15).

Further, in comparing the history information D (R:60) and the history information D (R:50) (refer to S13), totals thereof may be compared or portions thereof may be compared. Further, before comparing the history information D (R:60) and the history information D (R:50) (S13), the controller 61 needs to read the history information D (R:50) inside the cartridge storing portion 50, the timing may be simultaneous with reading the inherent information D (S:50)

or maybe after determining that the inherent information D (S:60) and inherent information D (S:50) coincide with each other (refer to S12).

FIG. 9 is a flowchart when the information D (i+1) is written from the main body storing portion 60 to the cartridge storing portion 50 after determining whether the process cartridge 5 has been interchanged. First, after operation of forming one image has been finished and the information D inside the main body storing portion 60 has been updated (refer to FIG. 7B), the controller 61 reads only inherent information D (S) in the information D stored to the cartridge storing portion 50 (S20). Further, the inherent information D (S:60) stored to the main body storing portion 60 and read inherent information D (S:50) are compared (S21) Further, when the inherent information D (S:60) and the inherent information D (S:50) coincide with each other, further, the history information D (R:60) stored to the main body storing portion 60 and read history information D (R:50) are compared (S22). Further, when the history information D (R:60) and the history information D (R:50) coincide with each other, the controller 61 writes updated information D (i+1) from the main body storing portion 60 to the cartridge storing portion 50 (S24).

Meanwhile, when the inherent information D (S:60) and the inherent information D (S:50) differ from each other (S21), or in the case in which the history information D (R:50) is larger than the history information D (R:60) (even when the inherent information D (S:60) and the inherent information D (S:50) coincide with each other)(S22), the controller 61 reads the information D stored to the cartridge storing portion 50 to the main body storing portion 60 (the controller 61 does not write the updated information D (i+1) from the main body storing portion 60 to the cartridge storing portion 50)(S23).

A time period from determining whether the information in the main body storing portion 60 can be written to the cartridge storing portion 50 until writing the information in the main body storing portion 60 to the cartridge storing portion 50 is shorter than a time length necessary for the cartridge to be pulled out by an operator. Preferably, the time period is independent of whether other step interposes from determining whether the information in the main body storing portion 60 can be written to the cartridge storing portion 50 until the information in the main body storing portion 60 is written to the cartridge storing portion 50.

Further specifically, the determining section can determine whether the information in the main body storing portion can be written to the unit storing portion based on whether the information in the main body storing portion and the information in the unit storing portion coincide with each other. Further, the determining section can determine whether the information in the main body storing portion can be written to the unit storing portion based on whether a portion of the information in the main body storing portion and a portion of the information in the unit storing portion coincide with each other.

Further, the information includes inherent information inherent to the unit, and the determining section can determine whether the information in the main body storing portion can be written to the unit storing portion based on inherent information in the main body storing portion and the inherent information in the unit storing portion. Further, the information includes history information indicating a history of using the unit, and the determining section can determine whether the information in the main body storing portion can be written to the unit storing portion based on history information in the main body storing portion and the history information in the unit storing portion. Further, the determining section can determine whether the information in the main body storing portion can be written to the unit storing portion based on a portion of the history information in the main body storing portion and a portion of the history information in the unit storing portion. Further, the information includes inherent information inherent to the unit and history information indicating a history of using the unit, and the determining section can primarily determine whether the information in the main body storing portion can be written to the unit storing portion based on inherent information in the main body storing portion and the inherent information in the unit storing portion and secondarily determine whether the information in the main body storing portion can be written to the unit storing portion based on history information in the main body storing portion and the history information in the unit storing portion. Further, the information may include control information indicating an image forming parameter.

The unit may be any one of a process cartridge, a toner cartridge, and a fixing unit. Further, the reading section and the writing section may read information and write information by a wire or wireless. Further, the reading section and the writing section may read information and write information by light.

Further specifically, the determining step may determine whether the information in the main body storing portion can be written to the unit storing portion based on whether the information in the main body storing portion and the information in the unit storing portion coincide with each other. Further, the determining step may determine whether the information in the main body storing portion can be written to the unit storing portion based on whether a portion of the information in the main body storing portion and a portion of the information in the unit storing portion coincide with each other.

Further, the information may include inherent information inherent to the unit and the determining step may determine whether the information in the main body storing portion can be written to the unit storing portion based on inherent information in the main body storing portion an the inherent information in the unit storing portion. Further, the information may include history information indicating a history of using the unit, and the determining step may determine whether the formation in the main body storing portion can be written to the unit storing portion based on history information in the main body storing portion and the history information in the unit storing portion. Further, the determining step may determine whether the information in the storing portion can be written to the unit storing portion based on a portion of the history information in the main body storing portion and a portion of the history information in the unit storing portion. Further, the information may include inherent information inherent to the unit and history information indicating a history of using the unit, and the determining step may primarily determine whether the information in the main body storing portion can be written to the unit storing portion based on inherent information in the main body storing portion and the inherent information in the unit storing portion and secondarily determine whether the information in the main body storing portion can be written to the unit storing portion based on history information in the main body storing portion and the history information in the unit storing portion. Further, the information may include control information indicating an image forming parameter.

Further, although according to the embodiment, as the image forming apparatus, a full color printer of an electronic photography system is pointed out as an example, the invention is not limited thereto but the invention is naturally applicable to a full color printer of an ink jet system, a single color (black and white) printer, a copier, a facsimile, a compound machine and the like. Further, although according to the embodiment, the process cartridge 5 is constituted as the unit attachable to the main body 6, the invention is not limited thereto but, for example, a toner cartridge or a fixing unit can also be constituted as a unit attachable to the main body 6.

The time period from determining whether the information in the main body storing portion 60 can be written to the cartridge storing portion 50 until writing the information in the main body storing portion 60 to the cartridge storing portion 50 is not limited thereto but it may be shorter than a time length necessary for the operator to open the front door (not-shown) of the printer and to pull out the cartridge.

The entire disclosure of Japanese Patent Application No. 2003-351099 filed on Oct. 9, 2003 including specification, claims, drawings and abstract is incorporated herein by reference in its entirety.

What is claimed is:

1. An image forming apparatus comprising:

a main body;

a main body storing portion provided at the main body;

a unit attachable to the main body;

a unit storing portion provided at the unit;

a reading section to read information in the unit storing portion to the main body storing portion;

an updating section to update information in the main body storing portion, the information includes history information indicating a history of using the unit;

a writing section to write the information in the main body storing portion to the unit storing portion; and a determining section to determine whether the information in the main body storing portion can be written to the unit storing portion based on history information in the main body storing portion and history information in the unit storing portion before writing the information in the main body storing portion to the unit storing portion.

2. The image forming apparatus according to claim 1, wherein the determining section determines whether the information in the main body storing portion can be written to the unit storing portion based on whether the information in the main body storing portion and the information in the unit storing portion coincide with each other.

3. The image forming apparatus according to claim 1, wherein the information includes inherent information inherent to the unit, and the determining section determines whether the information in the main body storing portion can be written to the unit storing portion based on inherent information in the main body storing portion and inherent information in the unit storing portion.

4. The image forming apparatus according to claim 1, wherein the history information includes an accumulated revolution number of a photosensitive drum, an accumulated number of operation of a developer carrying member inside a processing apparatus, an accumulated coverage rate of a toner portion in an image, a situation of using the unit, information of recycling the unit, location of fabrication, and a date of fabrication.

5. The image forming apparatus according to claim 1, wherein the determining section determines whether the information in the main body storing portion can be written to the unit storing portion based on a part of the history information in the main body storing portion and a part of the history information in the unit storing portion.

6. The image forming apparatus according to claim 1, wherein the information includes inherent information inherent to the unit and the determining section primarily determines whether the information in the main body storing portion can be written to the unit storing portion based on inherent information in the main body storing portion and inherent information in the unit storing portion, and secondarily determines whether the information in the main body storing portion can be written to the unit storing portion based on history information in the main body storing portion and history information in the unit storing portion.

7. The image forming apparatus according to claim 6, wherein the history information includes an accumulated revolution number of a photosensitive drum, an accumulated number of operation of a developer carrying member inside a processing apparatus, an accumulated coverage rate of a toner portion in an image, a situation of using the unit, information of recycling the unit, location of fabrication, and a date of fabrication.

8. The image forming apparatus according to claim 1, wherein the information includes control information indicating an image forming parameter.

9. The image forming apparatus according to claim 1, wherein the unit is any one of a process cartridge, a toner cartridge, and a fixing unit.

10. The image forming apparatus according to claim 1, wherein the reading section and the writing section read information and write the information by a wire or wireless.

11. The image forming apparatus according to claim 1, wherein the reading section and the writing section read the information and write the information by light.

12. A unit of an image forming apparatus having a unit storing portion to store information and attachable to an image forming main body, wherein information in the unit storing portion includes history information indicating a history of using the unit and is read to the main body storing portion of the image forming main body, updated and written to the unit storing portion, wherein it is determined whether information in the main body storing portion can be written to the unit storing portion based on history information in the main body storing portion and history information in the unit storing portion before writing the information in the main body storing portion to the unit storing portion.

13. An information control method applied to an image forming apparatus comprising:

a main body;

a main body storing portion provided to the main body, a unit attachable to the main body;

a unit storing portion provided at the unit and including a reading step of reading information in the unit storing portion to the main body storing portion, an updating step of updating information in the main body storing portion, and a writing step of writing the information in the main body storing portion to the unit storing portion, the information includes history information indicating a history of using the unit; and a determining step of determining whether the information in the main body storing portion can be written to the unit storing portion based on history information in the main body storing portion and history information in the unit storing portion before the writing step.

14. The information control method of an image forming apparatus according to claim 13, wherein the determining steps determines whether the information in the unit storing portion can be written to the main body storing portion based on whether the history information in the main body storing portion and the history information in the unit storing portion coincide with each other.

15. The information control method of an image forming apparatus according to claim 13, wherein the determining steps determines whether the information in the unit storing portion can be written to the main body storing portion based on whether a part of the history information in the main body storing portion and a part of the history information in the unit storing portion coincide with each other.

16. The information control method of an image forming apparatus according to claim 13, wherein the information includes inherent information inherent to the unit, and the determining step determines whether the information in the main body storing portion can be written to the unit storing portion based on inherent information in the main body storing portion and inherent information in the unit storing portion.

17. The information control method of an image forming apparatus according to claim 13, wherein the history information includes an accumulated revolution number of a photosensitive drum, an accumulated number of operation of a developer carrying member inside a processing apparatus, an accumulated coverage rate of a toner portion in an image, a situation of using the unit, information of recycling the unit, location of fabrication, and a date of fabrication.

18. The information control method of an image forming apparatus according to claim 13, wherein the determining step determines whether the information in the main body storing portion can be written to the unit storing portion based on a part of the history information in the main body storing portion and a part of the history information in the unit storing portion.

19. The information control method of an image forming apparatus according to claim 13, wherein the information includes inherent information inherent to the unit, and the determining step primarily determines whether the information in the main body storing portion can be written to the unit storing portion based on inherent information in the main body storing portion and inherent information in the unit storing portion, and secondarily determines whether the information in the main body storing portion can be written to the unit storing portion based on history information in the main body storing portion and history information in the unit storing portion.

20. The information control method of an image forming apparatus according to claim 19, wherein the history information includes an accumulated revolution number of a photosensitive drum, an accumulated number of operation of a developer carrying member inside a processing apparatus, an accumulated coverage rate of a toner portion in an image, a situation of using the unit, information of recycling the unit, location of fabrication, and a date of fabrication.

21. The information control method of an image forming apparatus according to claim 13, wherein the information includes control information indicating an image forming parameter.

22. An image forming apparatus comprising:

a main body;

a main body storing portion provided at the main body;

a unit attachable to the main body;

a unit storing portion provided at the unit;

a reading section to read information in the unit storing portion to the main body storing portion;

an updating section to update information in the main body storing portion;

a writing section to write the information in the main body storing portion to the unit storing portion; and a determining section to determine whether the information in the main body storing portion can be written to the unit storing portion based on the information in the main body storing portion and the information in the unit storing portion before writing the information in the main body storing portion to the unit storing portion, wherein the reading section reads only inherent information in the information in the unit storing portion after the information in the main body storing portion is updated, the determining section compares inherent information in the information in the main body storing portion and the inherent information in the information in the unit storing portion, when the inherent information in the information in the main body storing portion and the inherent information in the information in the unit storing portion coincide with each other compares history information stored in the main body storing portion and read history information, and when the history information stored in the main body storing portion is equal to or less than the read history information renders the writing section to write the updated information in the main body storing portion to the unit storing portion and permits to form an image.

23. The image forming apparatus according to claim 22, wherein when the inherent information in the information in the main body storing portion and the inherent information in the information in the unit storing portion do not coincide with each other or when the history information stored in the main body storing portion is larger than the read history information, the determining section renders the reading section to read the information in the unit storing portion to the main body storing portion.

24. The image forming apparatus according to claim 22, wherein the history information includes an accumulated revolution number of a photosensitive drum, an accumulated number of operation of a developer carrying member inside a processing apparatus, an accumulated coverage rate of a toner portion in an image, a situation of using the unit, information of recycling the unit, location of fabrication, and a date of fabrication.

* * * * *